US011532863B2

(12) United States Patent
Barry et al.

(10) Patent No.: US 11,532,863 B2
(45) Date of Patent: Dec. 20, 2022

(54) BROADBAND CIRCULATOR AND METHOD OF MANUFACTURING THE SAME

(71) Applicant: SMITHS INTERCONNECT, INC., Tampa, FL (US)

(72) Inventors: David E. Barry, Dunedin, FL (US); James P. Kingston, Tampa, FL (US)

(73) Assignee: TRAK MICROWAVE LIMITED

( * ) Notice: Subject to any disclaimer, the term of this patent is extended or adjusted under 35 U.S.C. 154(b) by 141 days.

(21) Appl. No.: 16/771,613

(22) PCT Filed: Dec. 14, 2018

(86) PCT No.: PCT/US2018/065740

§ 371 (c)(1),
(2) Date: Jun. 10, 2020

(87) PCT Pub. No.: WO2019/118870

PCT Pub. Date: Jun. 20, 2019

(65) Prior Publication Data

US 2021/0175592 A1 Jun. 10, 2021

Related U.S. Application Data

(60) Provisional application No. 62/598,935, filed on Dec. 14, 2017.

(51) Int. Cl.
*H01P 1/387* (2006.01)
*H01P 11/00* (2006.01)

(52) U.S. Cl.
CPC ..... *H01P 1/387* (2013.01); *H01P 11/001* (2013.01)

(58) Field of Classification Search
CPC .. H01P 1/387; H01P 1/38; H01P 1/383; H01P 1/393; H01P 1/32; H01P 1/36; H01P 11/001; H01P 11/003; H01P 11/007
See application file for complete search history.

(56) References Cited

U.S. PATENT DOCUMENTS 4,920,323 A 4/1990 Schloemann et al.
2004/0174224 A1 9/2004 Kingston et al.
(Continued)

FOREIGN PATENT DOCUMENTS

KR 10-0527920 11/2005
KR 10-1007544 1/2011

OTHER PUBLICATIONS

International Search Report and Written Opinion of the International Searching Authority (dated Apr. 8, 2019) for Corresponding International PCT Patent Application No. PCT/US2018/065740, filed Dec. 14, 2018.

*Primary Examiner* — Stephen E. Jones
(74) *Attorney, Agent, or Firm* — Snell & Wilmer LLP

(57) ABSTRACT

A broadband microstrip ferrite circulator or isolator includes a carrier. The broadband microstrip ferrite circulator or isolator further includes a dielectric substrate having an opening therein. The broadband microstrip ferrite circulator or isolator further includes a ferrite disc positioned within the opening of the dielectric substrate. The broadband microstrip ferrite circulator or isolator further includes a conductor having three contacts extending therefrom, the conductor being positioned on the ferrite disc. The broadband microstrip ferrite circulator or isolator further includes a magnet. The broadband microstrip ferrite circulator or isolator further includes a spacer positioned between the conductor and the magnet.

13 Claims, 2 Drawing Sheets

(56) References Cited

U.S. PATENT DOCUMENTS

| | | | | |
|---|---|---|---|---|
| 2006/0017520 | A1* | 1/2006 | Kingston | H01P 1/387 333/1.1 |
| 2006/0139118 | A1* | 6/2006 | Vaughn | H01P 1/387 333/1.1 |
| 2008/0254313 | A1* | 10/2008 | Kennedy | H05K 3/4626 29/831 |
| 2009/0235745 | A1* | 9/2009 | Dwyer | G01P 15/132 73/514.23 |
| 2010/0117754 | A1* | 5/2010 | Yamamoto | H01P 1/387 333/1.1 |
| 2017/0338538 | A1 | 11/2017 | Kingston et al. | |
| 2019/0139702 | A1* | 5/2019 | Kitamura | H01P 1/32 |

* cited by examiner

BROADBAND CIRCULATOR AND METHOD OF MANUFACTURING THE SAME

CROSS-REFERENCE TO RELATED APPLICATIONS

This application claims the benefit and priority of U.S. Provisional patent Application No. 62/598,935, titled "Broadband Circulator and Method of Manufacturing the Same" and filed on Dec. 14, 2017, the entire contents of which is hereby incorporated by reference herein.

BACKGROUND

1. Field

The present disclosure generally relates to broadband resonance circulators and methods of manufacturing broadband resonance circulators.

2. Description of the Related Art

Below resonance circulators and isolators are devices that are designed for applications from three Gigahertz (3 GHz) to over 30 GHz. Such circulators and isolators may be used in radio and radar frequency applications such as radar scanners, high-definition radio transmitters, or the like.

Conventional circulators may have potential drawbacks to their design. For example, these circulators may be relatively lossy outside of a narrow bandwidth, resulting in relatively high field loss. Additionally, these circulators may include an epoxy that is cured at a relatively low temperature, resulting in damage to the circulator during processing of the circulator.

Thus, there is a need in the art for below resonance circulators that provide relatively low field loss at a larger bandwidth, and that can be processed without resulting in damage to the circulators.

SUMMARY

Disclosed herein is a broadband microstrip ferrite circulator or isolator. The broadband microstrip ferrite circulator or isolator includes a carrier. The broadband microstrip ferrite circulator or isolator further includes a dielectric substrate having an opening therein. The broadband microstrip ferrite circulator or isolator further includes a ferrite disc positioned within the opening of the dielectric substrate. The broadband microstrip ferrite circulator or isolator further includes a conductor having three contacts extending therefrom, the conductor being positioned on the ferrite disc. The broadband microstrip ferrite circulator or isolator further includes a magnet. The broadband microstrip ferrite circulator or isolator further includes a spacer positioned between the conductor and the magnet.

Also disclosed is a broadband microstrip circulator. The broadband microstrip circulator includes a conductive carrier. The broadband microstrip circulator further includes a planar dielectric substrate defining an opening therein. The broadband microstrip circulator further includes a planar ferrite component located within the opening defined by the planar dielectric substrate. The broadband microstrip circulator further includes a conductor located adjacent to the planar ferrite component such that the planar ferrite component is located between the conductor and the conductive carrier. The broadband microstrip circulator further includes a magnet located such that the conductor is located between the magnet and the planar ferrite component.

Also disclosed is a method of manufacturing a circulator. The method includes forming a pre-circulator structure by stacking, in order, a carrier, a first adhesive, a dielectric substrate having an opening therein, a ferrite disc in the opening of the dielectric substrate, a second adhesive, a conductor having a center portion with three legs extending therefrom, a third adhesive, a spacer, a fourth adhesive, and a magnet. The method further includes applying pressure to the pre-circulator structure and heating the pre-circulator structure with the pressure applied to a temperature in order to cure the first adhesive, the second adhesive, the third adhesive, and the fourth adhesive.

BRIEF DESCRIPTION OF THE DRAWINGS

Other systems, methods, features, and advantages of the present invention will be or will become apparent to one of ordinary skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Described herein are below resonance circulators (which may also be referred to as isolators) and methods for manufacturing such circulators. The circulators are formed with an independent center conductor and without an external compressive force, such as a housing. The circulators further include a single ferrite element without any film metallization thereon. Various components of the circulators may be coupled together using an adhesive, such as a low loss nonconductive microwave epoxy (e.g., a low loss nonconductive sheet epoxy).

The circulators described herein have various advantages over conventional circulators. Use of a single non-metallized ferrite element and use of the independent center conductor reduces a total quantity of components relative to conventional circulators. Furthermore, use of the microwave adhesives reduces or eliminates a need for a housing. The reduced quantity of components and the lack of a housing may reduce manufacturing costs of the circulator. The particular designs disclosed herein result in a relatively high-performance circulator that is compatible with tape and reel packaging.

Additionally, the circulators disclosed herein may be processed at a sufficiently high temperature that the adhesives survive the curing process and any soldering process without any structural damage. The circulators also provide desirable characteristics over a relatively broad bandwidth, such as between 4 Gigahertz (GHz) and 18 GHz. The circulators may provide a functional bandwidth of at least 30 percent (30%) in any area within this range, or even outside of this range. For example, if the target bandwidth is 5 GHz, the circulators may provide a functional bandwidth of between 3.5 GHz and 6.5 GHz. This results in relatively low field loss of the circulators.

Figure 1:
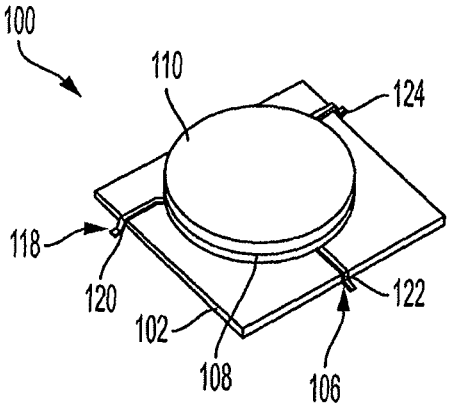
FIG. 1 is a perspective view of a circulator that is packaged in such a way as to be compatible with tape and reel packaging and having microwave adhesives as a bonding agent between various components of the circulator according to an embodiment of the present disclosure.
Figure 2:
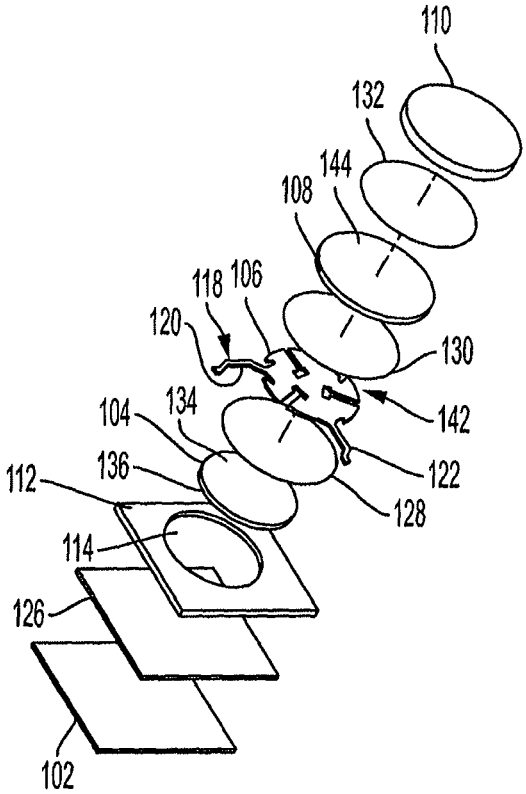
FIG. 2 is an exploded view of the below resonance circulator of FIG. 1 according to an embodiment of the present disclosure.

Referring to FIGS. 1 and 2, an exemplary circulator 100 is shown. The circulator 100 may include a carrier 102, a dielectric substrate 112 defining an opening 114 therein, a ferrite disc 104 located in the opening 114, a conductor 106, an insulator 108, and a magnet 110. The carrier 102 may be conductive and may function as a ground plane. The carrier 102 may include a plurality of ground members (not shown) extending outward from the carrier 102, or may function as a ground member and be electrically connected to ground of an element upon which the circulator 100 is mounted, such as on a circuit board.

The dielectric substrate 112 may include various materials such as a ceramic, Kapton, microwave board materials such as resin-impregnated glass, a low loss microwave substrate, or the like. The dielectric constant of the dielectric substrate 112 may be, for example, between 2 and 50, between 10 and 40, or about 35. Where used in this context, "about" refers to the referenced value plus or minus 10% of the referenced value. The dielectric constant of the dielectric substrate 112 may be selected based on the requirements of a system in which the circulator 100 is used.

The various components of the broadband circulator 100 can be formed in the shape of a circle, a triangle, a rectangle, a square, and/or combinations thereof. The shapes of the components can vary depending on the performance needs of the broadband circulator. In that regard, the opening 114 of the dielectric substrate 112, along with the ferrite disc 104, may have any shape. For example, the opening 114 and the ferrite disc 104 may have a round shape, as shown, an oval shape, a square shape, a triangular shape, or the like. In addition, the dielectric substrate 112 may have any shape such as square (as shown), circular, triangular, or the like. The ferrite disc 104 may contact the dielectric substrate 112 or may be separated from the dielectric substrate 112 by a gap.

By placing the ferrite disc 104 within the opening 114, the functional bandwidth provided by the circulator 100 is increased, by as much as 30% or more. Additionally, this configuration of the ferrite disc 104 within the opening 114 results in lower field loss than other circulator designs.

The ferrite disc 104 may be biased by the magnet 110 to create a chamber within the ferrite disc 104. As will be described below, this chamber is where operations on the signals occur. Unlike ferrite elements used in conventional microstrip circulators, the ferrite disc 104 may be non-metallized meaning it may have no plating positioned thereon. Additionally, the dielectric substrate 112 may be non-metallized.

The conductor 106 is designed to receive and output signals of the circulator 100. In that regard, the conductor 106 includes a plurality of legs, e.g., three legs 118, that each correspond to a signal path of the circulator. Each of the three legs 118 may be spaced apart by approximately 120 degrees. In various embodiments, each leg may be spaced an equidistance apart from one another. In some embodiments, each of the three legs 118 may be spaced apart by any distance between 95 degrees and 145 degrees, or between 100 degrees and 140 degrees, or between 110 degrees and 130 degrees. The three legs 118 may be oriented in any configuration such as a "T" configuration (as shown in FIG. 1), a "Y" configuration (as shown in FIG. 2), an "L" configuration, or the like.

The insulator 108 may insulate the center conductor 106 from the magnet 110. In some embodiments, the insulator 108 may include a sleeve or a spacer. In that regard, the insulator 108 may include any insulator such as plastic, ceramic, or the like.

As mentioned above, the magnet 110 may bias the ferrite disc 104 to create the chamber within the ferrite disc 104.

In operation, a signal may be received by a first leg 120. As the signal travels inward along the first leg 120, it may be received within the chamber of the ferrite disc 104 where it may resonate. Based on the direction of bias of the ferrite disc 104 (which is controlled by the polarity of the magnet 110), the signal may be output as a null signal on a second leg 122 or on a third leg 124, and may be output as a signal that closely resembles the input signal on the other of the second leg 122 or the third leg 124. In some embodiments, the circulator 100 may be designed to operate between 2 gigahertz (GHz) and 30 GHz, between 3 GHz and 20 GHz, between 4 GHz and 18 GHz, or the like.

Each of the legs 118 of the conductor 106 may be bent such that a bottom surface of each of the legs 118 is relatively flush with a bottom surface of the carrier 102. In that regard, the circulator 100 may be mounted on a circuit board 200. The circulator 100 may be electrically and mechanically coupled to the circuit board 200 by applying solder to a joint between the circuit board 200 and the carrier 102, and by applying solder to a joint between the circuit board 200 and each of the legs 118. In that regard, each of the legs 118 may also be electrically connected to a corresponding signal trace, and the carrier 102 may be electrically connected to a ground trace.

As shown in FIG. 2, various adhesives may be used between adjacent components. In particular, a first adhesive 126 may be positioned between the carrier 102 and the dielectric substrate 112 and between the carrier 102 and the ferrite disc 104. A second adhesive 128 may be positioned between the dielectric substrate 112 and the conductor 106 and between the ferrite disc 104 and the conductor 106. A third adhesive 130 may be positioned between the conductor 106 and the insulator 108. A fourth adhesive 132 may be positioned between the insulator 108 and the magnet 110.

The adhesives 126, 128, 130, 132 may be used to bond the various components of the circulator 100 together. In that regard, use of the adhesives 126, 128, 130, 132 reduces or eliminates the need for a housing, thus reducing an overall weight and cost of the circulator 100.

Some or all of the adhesives 126, 128, 130, 132 may include low loss microwave adhesives. In particular, the first adhesive 126, the second adhesive 128, and the third adhesive 128 may include a low loss microwave adhesive, and the fourth adhesives 130 may include a structural adhesive. In some embodiments, the fourth adhesive 130 may also or instead include a microwave adhesive, or the first, second, and third adhesives 126, 128, 130 may include a structural adhesive. In some embodiments, the microwave adhesive may be used as the second adhesive 128. In these embodiments, other adhesives may be used between the other components of the circulator 100. In some embodiments, each of the adhesives 126, 128, 130, 132 may include one or more of a microwave adhesive or a non-microwave adhesive.

It is desirable for the microwave adhesives 103, 105, 107 to have certain characteristics in order to improve performance of the circulator 100. In particular, it is desirable for the microwave adhesives, to have one or more of the following characteristics:

(1) to have a relatively low loss tangent at microwave frequencies (such as having a dissipation factor less than 0.004, less than 0.003, or less than 0.0025 at 10 GHz) in order to keep insertion loss of the device low;

(2) to have nonconductive properties in order to allow the microwave adhesives to be utilized between each component of the circulator 100 without reducing performance of the circulator 100;

(3) to have a relatively high melting temperature (such as above 175 degrees Celsius, or above 200 degrees Celsius, or above 230 degrees Celsius) in order to allow the microwave adhesives to withstand curing and solder reflow temperatures;

(4) to have relatively high chemical resistance in order to allow the adhesives to withstand cleaning processes to which the circulator may be exposed (such as resistance to chemicals including acetone alcohol and degreasers); and (5) to be available in a thickness that is between 0.0001 inches and 0.005 inches, between 0.0005 inches and 0.003 inches, or between 0.001 inches and 0.002 inches in order to allow the adhesives to minimally impact microwave signals.

An exemplary microwave adhesive suitable for use in the circulator 100 may include ULTRALAM® 3908, available from Rogers Corporation of Rogers, Conn.

The carrier 102 may include a conductive metal. In some embodiments, the metal may include a magnetic material such as steel, stainless steel, Kovar, Silver, Gold, Copper, or the like. In some embodiments, the carrier 102 may be metallized. In particular, the carrier 102 may include plating, such as silver plating or gold plating, in order to reduce insertion loss of signals.

The magnetic properties of the carrier 102 may function to attract magnetic fields generated by the magnet 110. By attracting such magnetic fields, the carrier 102 increases the likelihood that the magnetic fields travel in a direction perpendicular to a first side 134 and a second side 136 of the ferrite disc 104. Stated differently, the carrier 102 increases the likelihood that the magnetic fields travel straight through the ferrite disc 104 from the first side 134 to the second side 136. Causing the magnetic fields to travel perpendicular to the sides 134, 136 of the ferrite disc 104 increases the performance of the circulator 100.

The shape of the carrier 102 may be square, rectangular, circular, oval, or the like. The thickness of the carrier 102 may vary based on the application. For example, the thickness of the carrier may be between 0.001 inches and 0.1 inches (0.025 mm and 2.54 mm) or between 0.01 inches and 0.04 inches (0.25 mm and 1.0 mm).

The ferrite disc 104 may have any shape, such as square, rectangular, circular, oval, or the like. In some embodiments and as shown, the ferrite disc 104 may have a circular shape. The circular shape may be desirable as it is cheaper to produce a circular ferrite disc than a ferrite disc having a different shape. Thus, the circular shape may result in a reduced cost of the circulator 100.

The ferrite disc 104 may have a diameter. In some embodiments, the diameter may be between 0.067 inches and 1 inch (1.7 millimeters (mm) and 25.4 mm), between 0.125 inches and 0.75 inches (3.18 mm and 19.1 mm), or between 0.125 inches and 0.5 inches (3.18 mm and 12.7 mm).

The ferrite disc 104 may have a thickness. In some embodiments, the thickness may be between 0.005 inches and 0.050 inches (0.13 mm and 1.3 mm), between 0.005 inches and 0.040 inches (0.13 mm and 1.0 mm), or between 0.010 inches and 0.040 inches (0.25 mm and 1.0 mm).

Unlike conventional circulators, the ferrite disc 104 of the circulator 100 may function without being metallized. The step of applying a metal plating to a ferrite disc may be relatively expensive. In that regard, forming the ferrite disc 104 of the circulator 100 without metallization results in significant cost savings when manufacturing the circulator 100.

The conductor 106 may include a conductive metal. In some embodiments, the metal of the conductor 106 may be nonmagnetic. For example, the conductor 106 may include brass, copper, beryllium copper, gold, silver, or the like. In some embodiments, the conductor 106 may be metallized. In that regard, the conductor 106 may be plated such as with silver or gold. Such metallization of the conductor 106 may reduce insertion loss, thus increasing performance of the circulator 100.

As described above, the conductor 106 may include three legs 118 extending therefrom. The conductor 106 may further include resonators 142 positioned between each of the three legs 118. The conductor 106 may include between one and four resonators positioned between each of the legs 118. As shown in FIG. 4, the conductor 106 includes two resonators 142 positioned between each of the legs 118.

The resonators 142 may dictate the operating frequency of the circulator 100. The resonators 142 may further aid in impedance matching of the circulator 100 by adding capacitance. In some embodiments, the resonators 142 may provide impedance matching for frequencies within 10%, or 20%, or 30% of a desired bandwidth. In order to achieve the desired effect, it is desirable for a diameter of the resonators 134 to be equal or less than a diameter of the magnet 110.

Use of the microwave adhesive as the second adhesive 128 between the ferrite disc 104 and the conductor 106 provides several advantages. For example, use of the microwave adhesive eliminates the need to include any thin or thick film deposition on the ferrite disc 104, thus reducing the manufacturing cost of the circulator 100.

The insulator 108 may include any insulating material. For example, the insulator 108 may include a plastic, a ceramic, a rubber, or the like. It is undesirable for the magnet 110 to contact the conductor 106. In that regard, the insulator 108 insulates the magnet 110 from the conductor 106. In some embodiments, the insulator 108 may function as a spacer. In some embodiments, the insulator 108 may include another shape, such as a sleeve positioned around the magnet 110 or around a portion of the conductor 106.

The insulator 108 may include a metal or other conductor positioned on some or all of a top surface 144. The metal may operate as a ground plane. In some embodiments, the metal may include copper or brass etched on to the insulator 108. Through experimentation, it was determined that use of the metal on the portion of the surface 144 alleviates current induced on the magnet 110. Accordingly, inclusion of the metal reduces losses experienced by the circulator 100.

The magnet 110 may include any magnetic material. For example, the magnet 110 may include samarium cobalt, ceramic barium ferrite, alnico, neodymium, or the like. The magnet 110 may include any shape such as a square, rectangle, triangle, circle, oval, or the like. It may be desirable to use a circular magnet as it is less expensive to form a circular magnet than any other shape. Accordingly, use of a circular magnet may result in reduced manufacturing costs.

Figure 3:
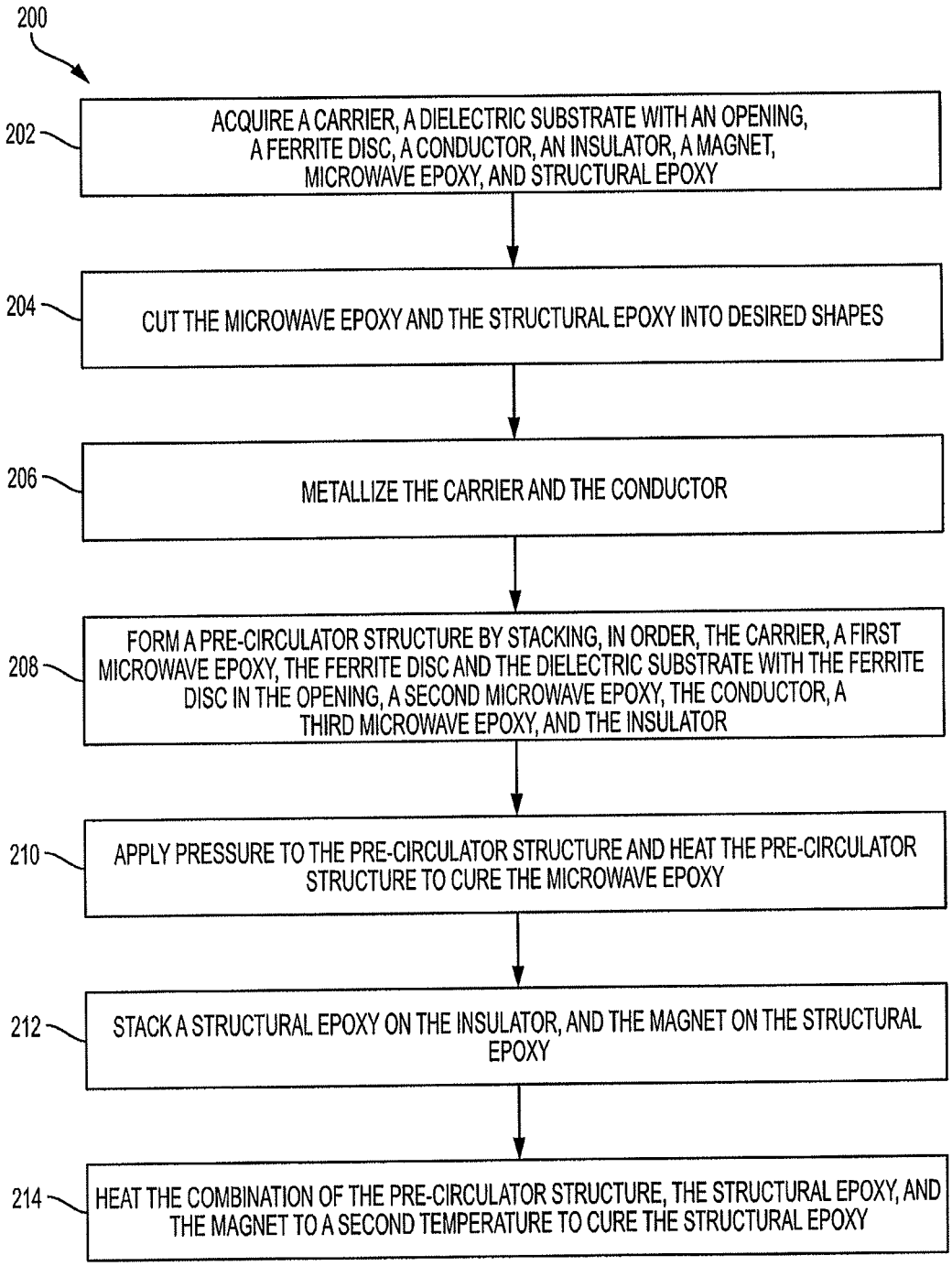
FIG. 3 is a flowchart illustrating a method for forming a circulator according to an embodiment of the present disclosure.

Turning to FIG. 3, a method 200 for forming a circulator, such as the circulator 100 of FIG. 1, is shown. In block 202, the method 200 includes acquiring a carrier, a dielectric substrate with an opening therein (or forming the opening), a ferrite disc, a conductor, an insulator, a magnet, a microwave adhesive, and a structural adhesive. The carrier, the dielectric substrate, the ferrite disc, the conductor, the insulator, and the magnet may be formed or purchased in their final shape. For example, these components may be formed by stamping, forging, or other processes known in the art. The microwave adhesives and the structural adhesives may be purchased in sheet form or in fluid form or may be manufactured using processes known in the art.

In block 204, the microwave adhesive and the structural adhesive may be cut into their desired shapes. For example and with brief reference to FIG. 2, each of the first adhesive 126, the second adhesive 128, and the third adhesive 128 may be cut to have the desired shape from the sheet of microwave adhesive. Likewise, the first adhesive 126, the second adhesive 128, and the third adhesive 128 may have substantially similar diameters (i.e., within 20%, or within 10%, or within 5% of each other). The fourth adhesive 130 may be cut to have the desired shape from the sheet of structural adhesive.

Returning reference to FIG. 3, the carrier and the conductor may optionally be metallized in block 206. For example, the carrier and the conductor may be plated with gold, silver, tin, copper, or the like.

In block 208, some of the components may be stacked on top of each other to form a pre-circulator structure. For example, the carrier may be positioned on a surface. A first microwave adhesive may be positioned on the carrier, and the dielectric substrate with the ferrite disc located in the opening may be positioned on the first microwave adhesive. A second microwave adhesive may be positioned on the combined dielectric material and ferrite disc and the conductor may be placed on the second microwave adhesive. A third microwave adhesive may be positioned on the conductor and the insulator may be positioned on the third microwave adhesive. The structural adhesives and the magnet may not be placed with the other components at this point.

In block 210, the pre-circulator structure may be cured in order to bond the components together. It is desirable for pressure to be applied to the components during the bonding process to ensure effective coupling between the components. In that regard, pressure may be applied to the pre-circulator structure at the same time heat is applied to bond the pre-circulator structure. The pressure may be applied, for example, using a clamp having ends that sandwich components from the carrier to the insulator.

For example, the applied pressure may be between 5 pounds per square inch (psi) and 40 psi (34 Kilopascals (kPa) and 276 kPa), between 10 psi and 30 psi (69 kPa and 207 kPa), or between 15 psi and 25 psi (103 kPa and 172 kPa). The applied temperature may be between 180 degrees Celsius (C) and 350 degrees C. (356 degrees Fahrenheit (F) and 662 degrees F.), between 200 degrees C. and 325 degrees C. (392 degrees F. and 617 degrees F.), or between 250 degrees C. and 300 degrees C. (482 degrees F. and 572 degrees F.).

The pressure may be applied during the entire heating phase. For example, the pre-circulator structure may be exposed to the high temperatures for 30 minutes and may remain exposed to the pressure for an additional 15 minutes after removal of the heat.

After the pre-circulator structure is cured, a structural adhesive may be stacked on the pre-circulator structure and the magnet may be stacked on the structural adhesive in block 212. For example, the structural adhesive may include Ablebond® 8700K, available from Henkel of Dusseldorf, Germany.

In block 214, the combination of the pre-circulator structure, the structural adhesive, and the magnet may be cured. For example, the combination may be exposed to relatively high temperatures in order to cause the structural adhesive to bond to the insulator and the magnet. For example, the combination may be exposed to temperatures between 150 degrees C. and 200 degrees C. (302 degrees F. and 392 degrees F.) or between 165 degrees C. and 185 degrees C. (329 degrees F. and 365 degrees F.).

After the structural adhesive has bonded to the magnet and the insulator, formation of the circulator may be complete.

Where used throughout the specification and the claims, "at least one of A or B" includes "A" only, "B" only, or "A and B." Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A broadband microstrip ferrite circulator or isolator, comprising:

a carrier;

a dielectric substrate having an opening therein and being non-metallized;

a first low loss microwave adhesive for attaching the dielectric substrate to the carrier, the first low loss microwave adhesive having a melting temperature of above 230 degrees Celsius in order to withstand curing and solder reflow temperatures;

a ferrite disc positioned within the opening of the dielectric substrate;

a conductor having three contacts extending therefrom, the conductor being positioned on the ferrite disc;

a second low loss microwave adhesive for attaching the conductor to the dielectric substrate and to the ferrite disc;

a magnet; and a spacer positioned between the conductor and the magnet.

2. The broadband microstrip ferrite circulator or isolator of claim 1 wherein the carrier is a plated steel carrier.

3. The broadband microstrip ferrite circulator or isolator of claim 1 wherein the carrier is a ferrous carrier.

4. The broadband microstrip ferrite circulator or isolator of claim 1 wherein the dielectric substrate is made of a ceramic material.

5. The broadband microstrip ferrite circulator or isolator of claim 1 wherein the ferrite disc is a no metallization ferrite disc.

6. The broadband microstrip ferrite circulator or isolator of claim 1 wherein the ferrite disc is a high saturation magnetization ferrite disc.

7. The broadband microstrip ferrite circulator or isolator of claim 1 wherein the conductor extends to an edge of the dielectric substrate to eliminate the need for a pattern on the dielectric substrate.

8. The broadband microstrip ferrite circulator or isolator of claim 1 wherein the conductor is a standalone conductor that is adhered to the ferrite disc with leads crossing a ferrite/dielectric gap.

9. The broadband microstrip ferrite circulator or isolator of claim 1 wherein the spacer is attached to the conductor using a third low loss microwave adhesive.

10. The broadband microstrip ferrite circulator or isolator of claim 1 wherein the magnet is attached to the spacer using a nonconductive adhesive.

11. The broadband microstrip ferrite circulator or isolator of claim 1 wherein the spacer has an integrated ground plane.

12. The broadband microstrip ferrite circulator or isolator of claim 1 wherein each of the three contacts of the conductor extends beyond an outer dimension of the carrier.

13. A method of manufacturing a circulator, comprising:

forming a pre-circulator structure by stacking, in order, a carrier, a first adhesive, a non-metallized dielectric substrate having an opening therein, a ferrite disc in the opening of the non-metallized dielectric substrate, a second adhesive, a conductor having a center portion with three legs extending therefrom, a third adhesive, a spacer, a fourth adhesive, and a magnet; and applying pressure to the pre-circulator structure and heating the pre-circulator structure with the pressure applied to a temperature between about 200 degrees Celsius and about 325 degrees Celsius in order to cure the first adhesive, the second adhesive, the third adhesive, and the fourth adhesive.

* * * * *